United States Patent [19]

Pringle et al.

[11] Patent Number: 4,562,854

[45] Date of Patent: Jan. 7, 1986

[54] PISTON ACTUATED CHEMICAL INJECTION VALVE

[75] Inventors: Ronald E. Pringle, Houston; Arthur J. Morris, Magnolia; John J. Johnson, Houston, all of Tex.

[73] Assignee: Camco, Incorporated, Houston, Tex.

[21] Appl. No.: 655,480

[22] Filed: Sep. 27, 1984

[51] Int. Cl.[4] ..... F04F 1/08

[52] U.S. Cl. ..... 137/155; 166/319

[58] Field of Search ..... 137/155, 68 R, 71; 166/319–322

[56] References Cited

U.S. PATENT DOCUMENTS

| | | | |
|---|---|---|---|
| 3,362,347 | 1/1968 | Canalizo | 137/155 X |
| 3,993,129 | 11/1976 | Watkins | 166/319 |
| 4,083,187 | 4/1978 | Nagashima | 60/407 |
| 4,452,310 | 6/1984 | Pringle et al. | 166/319 |
| 4,467,867 | 8/1984 | Baker | 166/188 |

OTHER PUBLICATIONS

Page 11, Camco Condensed Catalog 82/83.

Page 1331, Camco General Equipment Catalog 1980–1981.

*Primary Examiner*—Samuel Scott

*Assistant Examiner*—Allen J. Flanigan

*Attorney, Agent, or Firm*—Fulbright & Jaworski

[57] ABSTRACT

An injection valve for injecting chemicals into a well which is actuated by a piston having an upwardly and a downwardly directed metal cup seal with a resilient seal therebetween and a gas pressure charge above the piston acting to close the injection valve. Oil may be provided in the body between the gas charge and the piston for acting as a barrier. The gas charge may be placed in a closed gas container having a rupturable portion with a piercing means for opening the container. The container may include oil.

12 Claims, 4 Drawing Figures

PISTON ACTUATED CHEMICAL INJECTION VALVE

BACKGROUND OF THE INVENTION

In oil and gas wells with highly corrosive environments, it is sometimes desirable to inject chemical inhibitors into the producing stream to prevent damage to the well tubing. A conventional chemical injection valve is operated by a bellows enclosing a gas pressure charge, such as the Type BKLK-2, sold by Camco, Incorporated. Conventionally, the chemical injection valve is positioned in a sidepocket mandrel such as a Camco Type K mandrel in a well bore and is typically used for either a continuous flow or an intermittent chemical injection into the well. The valve is operated in response to a surface chemical pressure pump through a separate control conduit or the annulus around the well tubing to open the injection valve and allow injection of chemicals into the well. Such an application is more fully described and shown on page 11 of the Camco Condensed Catalog 82/83 which is incorporated herein by reference.

As wells are completed at greater depths, higher pressures (for example 10,000 psi) and temperatures are encountered and conventional bellows actuated valves are not satisfactory. That is, chemical injection valves frequently are required to open and close as many as 200,000 times in service and a bellows that is designed to provide the layers of metal of convoluted high strength to withstand high pressures will create a high spring rate effect and overstress, which will result in fatigue and failure.

The present invention is directed to providing an actuating piston to replace the bellows which will withstand the higher pressure and temperatures encountered and once opening pressure is achieved, travel in the piston valve may continue to assure full opening for maximum flow rate at injection. The piston actuated valve accomplishes this function with a lack of increasing forces such as spring or bellows rate. The volume of compressed gas is maximized in the piston actuated valve to prevent minimal charge pressure increase due to valve stem travel.

SUMMARY

The present invention is directed to an injection valve for injecting chemicals into a well having a body with spaced seal means on the exterior of the body for sealing in a well conduit. The body includes an inlet port between the seal means for receiving chemicals and a passageway leading from the inlet port to an outlet port. A valve seat and valve element is positioned in the passageway. A piston is positioned in the body above the inlet port and connnected to the valve element and the piston includes an upwardly directed metal cup seal, a downwardly directed metal cup seal, and, preferably, may include a resilient seal between the metal seals. The metal seals act as piston seals as they are expanded outwardly into a sealing contact with the interior of the body by fluid pressure and they act to protect the resilient seal from environmental conditions and the resilient seal provides an extra gas seal. A gas pressure charge is provided in the body above the piston and acts on the piston in a direction to close the valve element on the valve seat.

Still a further object of the present invention is the provision of oil in the body between the gas charge and the piston which acts as a barrier between the gas charge and the piston and which not only lubricates, but acts as a sealing medium as the liquid oil is easier to contain than the pressurized gas.

Still a further object of the present invention is wherein the pressurized gas is contained in a closed gas container above the piston for allowing easier storage of the valve. The container includes a rupturable portion and piercing means are provided adjacent the rupturable portion for opening the container for use.

Still a further object of the present invention is wherein the piercing means is positioned between the container and the piston. Yet a still further object is wherein biasing means is provided between the container and the piercing means for initially preventing the container from being opened until desired.

Yet a still further object of the present invention is wherein the container includes oil and wherein oil is provided in the body above the piston. Preferably, the container is positioned in a cylinder in the body which is sealed except for the piston therein reducing the possibility of gas leakage.

A further object of the present invention is the use of a high temperature fluorocarbon instead of the resilient seal whereby the valve can be used in extremely high temperature environments.

Other and further objects, features and advantages will be apparent from the following description of a presently preferred embodiment of the invention, given for the purpose of disclosure and taken in conjunction with the accompanying drawings.

DESCRIPTION OF THE PREFERRED EMBODIMENTS

Figure 1:
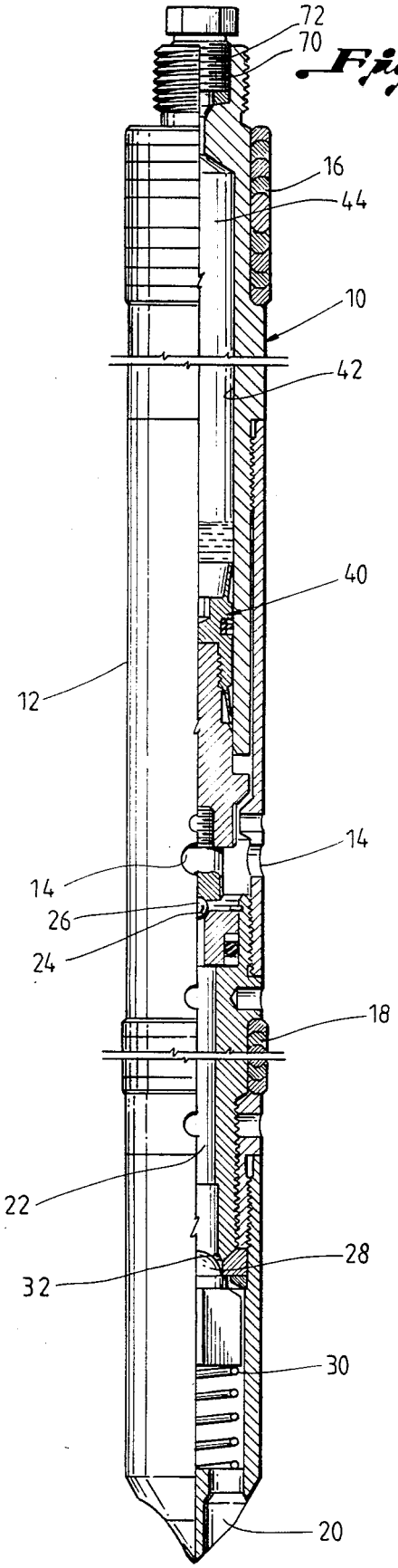
FIG. 1 is an elevational view in quarter section of the piston actuated chemical injection valve of the present invention.

Referring now to the drawings, particularly to FIG. 1, the reference numeral 10 generally indicates the chemical injection valve of the present invention and includes a body 12 having one or more inlet ports 14, an upper seal 16 on the exterior of the body 12, and a lower seal 18 on the exterior of the body 12, and an outlet port or ports 20. A fluid passageway 22 leads from the inlet ports 14 to the outlet ports 20 and a valve seat 24 and a valve element 26 are positioned in the passageway 22 for opening and closing communication through the passageway 22. Thus, the valve 10 can be placed in the sidepocket of a mandrel in which the pocket has an opening for receiving chemical fluids from a chemical pump on the well surface which is in communication with the mandrel and supplies chemcial fluid to the inlet port 14 between the seals 16 and 18.

When the valve element 26 is seated on the seat 24, the passageway 22 is closed and chemicals are prevented from being injected into the well tubing. However, when the fluid pressure applied at the inlet port 14 is increased, the valve element 26 will be retracted from the seat 24 opening the passageway 22 to allow the passage of chemical fluids through the passageway 22 and outlet ports 20.

Generally, a check valve which includes a valve element 28 is biased by a spring 30 in an upward direction to seat on the valve seat 32 for preventing well fluid from flowing from the outlet ports 20 to the inlet ports 14, but allows chemical injection flow in the opposite direction.

Normally, the valve element 26 is biased downwardly by a gas pressure charged bellows. However, as wells are deeper and encounter higher pressures and temperatures, bellows are not satisfactory for opening and closing a chemical injection valve which may be cycled as much as 200,000 times in service. In order to withstand the high pressures, for example 10,000 psi, a flexing bellows would require layers of convoluted high strength metal which would create a high spring rate effect and cause overstress which would result in fatigue and possible failure.

Therefore, the present invention is directed to an operating mechanism comprising a two-way metal-to-metal seal piston, preferably with an elastomer seal between the two metal seals which will (1) securely hold the gas pressure charge, (2) once opening pressure is achieved, travel in the valve may continue thereby assuring a full opening for maximum injection flow rate, (3) the lack of increasing opening biasing forces such as a spring or bellows rate and (4) the volume of compressed gas is maximized for preventing a pressure gas charge increase due to valve stem travel.

Figure 2:
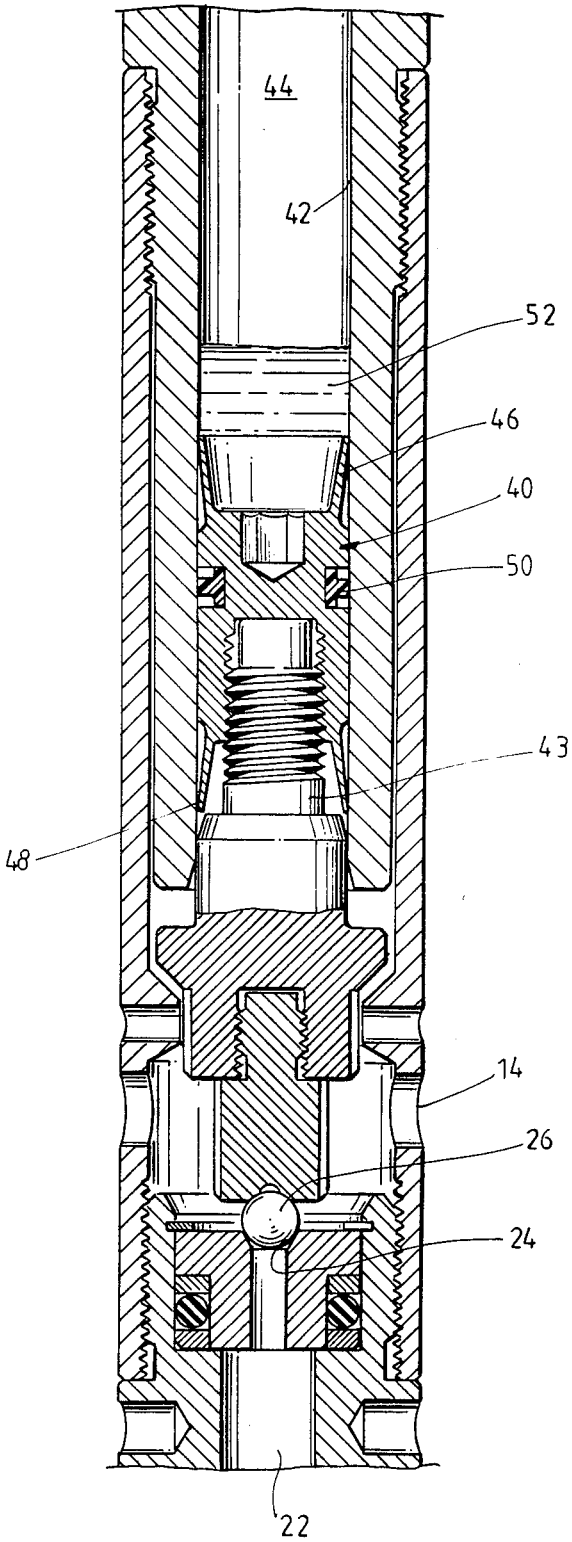
FIG. 2 is an enlarged fragmentary elevational view in cross section of a portion of the valve of FIG. 1.

Referring now to FIGS. 1 and 2, a piston generally indicated by the reference numeral 40 is provided connected to a piston rod 43 which in turn is connected to the valve element 26. The piston 40 is positioned in a cylinder 42 in the body 12 and is exposed on the bottom to the pressure of the injection fluid applied to the port 14 and is exposed on the top to the gas pressure charge 44, generally nitrogen. The piston 40 includes an upwardly directed metal cup seal 46 and a downwardly directed metal cup seal 48 and preferably a resilient elastomer seal 50, such as a T-seal positioned between the seals 46 and 48. The metal cup seals 46 and 48 are similar to the seal described in copending patent application Ser. No. 538,000, filed Sept. 30, 1983, and have the effect of being biased outwardly against the wall of the cylinder 42 to provide a sealing relationship, and they act to isolate the seal 50 from the environment and to prevent debris from adversely affecting the elastomer seal 50. The elastomer seal 50 is particularly effective in maintaining a gas tight seal. A predetermined amount of lubricant grease 52, such as Conoco gear oil DN-600, generally referred to as oil, is placed in the cylinder 42 above the piston 40 to act as a barrier between the gas charge 44 and the piston 40. The oil 52 will lubricate the walls of the cylinder 42 and will act as a sealing media as the oil is easier to contain than the gas 44. As the oil 52 is heavier than the gas 44 it will remain in the bottom of the cylinder 42 and adjacent the piston 40.

The elastomer seal 50 is used to provide a backup gas seal although bench tests have indicated that the metal cup seals 46 and 48 alone will provide a satisfactory gas seal. However, in applications where the valve 10 is used in environments having a temperature greater than 400° F., the elastomer seal 50 would be omitted entirely or replaced with a high temperature fluorocarbon trapped between the metal seals 46 and 48.

The precharging of the gas in the chamber 44 is generally accomplished prior to use at the surface temperature such as 60° F., but the thermal expansion, downhole temperature and pressure at which the valve 10 is to be used is calculated when precharging the valve 10. However, since it is desired that the oil 52, which is added to the cylinder 42 in the charging process, remain in contact with the piston 40 at all times the valve 10 should be maintained and stored in a generally vertical position in order to prevent the charge gas from contacting the seal 50.

Figure 3:
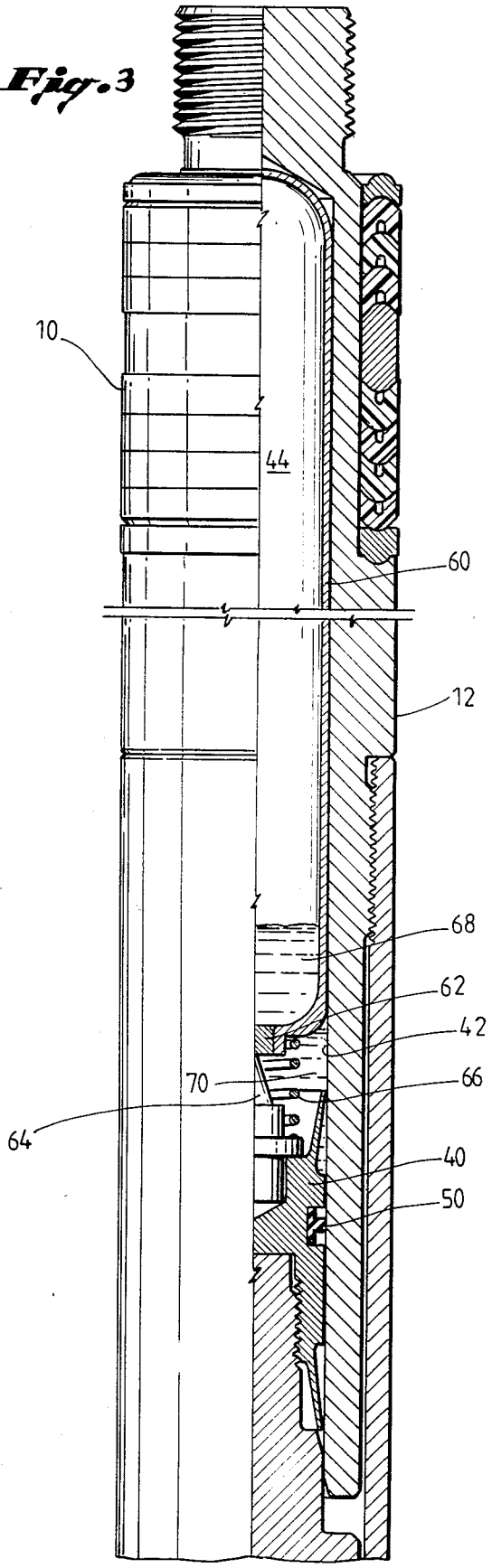
FIG. 3 is an enlarged fragmentary elevational view, in quarter section, in which the gas pressure charge is initially held in a closed container.
Figure 4:
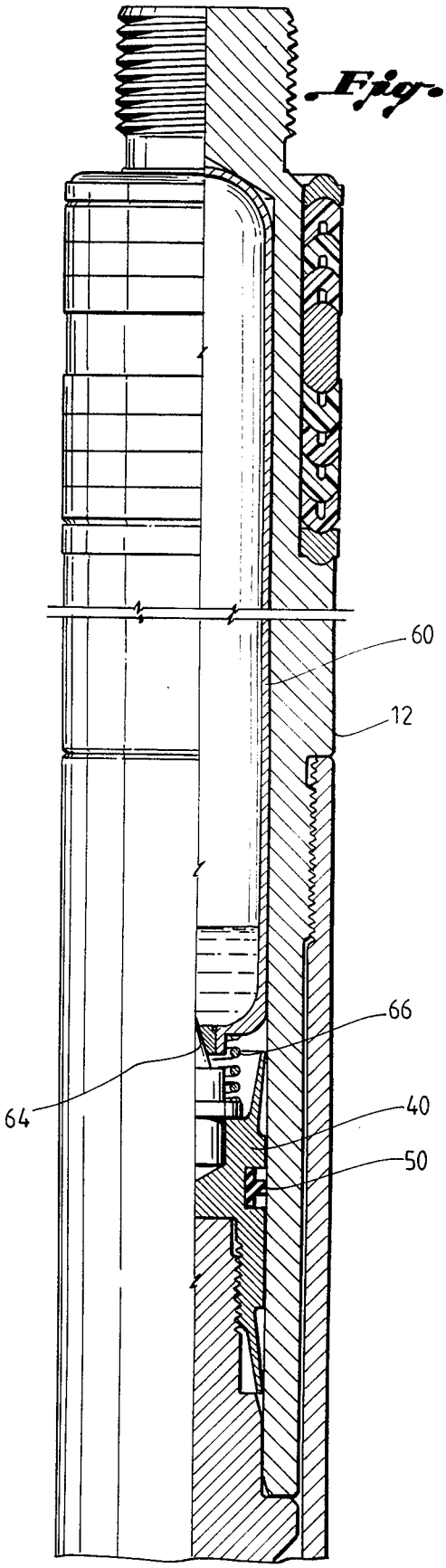
FIG. 4 is a view similar to FIG. 3 in which the container has been opened.

However, storage and transportation of the valve 10 in a vertical position may not always be accomplished by the service personnel. Therefore, in order to insure that the precharged gas 44 is unable to come in contact with the elastomer seal 50 the pressurized gas charge 44, as best seen in FIGS. 3 and 4, may be stored in a closed gas container 60 having a rupturable portion such as a rupture disc 62. Thus, the gas charge may be inserted into the container 60, the container 60 inserted into the cylinder 42, and the valve 10 may be stored and transported in any position without allowing the gas charge 44 to reach the resilient seal 50. In this case, piercing means such as a puncture hammer 64 is positioned adjacent the rupture disc 62 and preferably between the container 60 and the piston 40. Biasing means such as a spring 66 is provided between the hammer 64 and the container 60 for initially preventing the hammer 64 from puncturing the disc 62. Additionally, oil 68 is added to the container 60 when adding the charge gas 44, and oil 70 is preferably added in the cylinder 42 above the piston 40.

As best seen in FIG. 4, after the valve 10 is assembled and placed into the well, pressure at the inlet port 14 will be applied to the bottom of the piston 40, moving the puncture hammer 64 upwardly, overcoming the biasing spring 66, causing the puncture hammer 64 to rupture the disc 62 thereby releasing the gas charge 44 into the cylinder 42 above the piston 40 for normal operation. In addition, the oil 68 in the container 60 is forced through the punctured orifice and will act as a dampener against sudden impact.

While the closed gas container 60 is shown in use with a piston actuated chemical injection valve, the container 60 can also be used on other types of chemical injection valves, such as bellows actuated types. That is, the pressured gas container 60 would allow the use of a bellows actuated valve which has a thinner bellows as the bellows need not be subjected to a light differential pressure of the gas charge since the charge would not be applied to the bellows until it was placed in the well and offset by well pressure.

It is to be noted that in FIG. 1 the gas charge 44 is added to the cylinder 42 through an opening 70 and closed with a tail plug and seal 72, while in the device of FIG. 3, the only exposure of the cylinder 42 and thus of the gas charge is to the seals on the piston 40. Therefore, the container 60 shown in FIGS. 3 and 4 requires fewer seals and therefore is less likely to leak.

The present invention, therefore, is well adapted to carry out the objects and attain the ends and advantages mentioned as well as others inherent therein. While a presently preferred embodiment of the invention has been given for the purpose of disclosure, numerous changes in the details of construction and arrangement of parts will be readily apparent to those skilled in the art and which are encompassed within the spirit of the invention and the scope of the appended claims.

What is claimed is:

1. In an injection valve for injecting chemicals into a well having a body with spaced seal means on the exterior of the body for sealing in a well conduit, said body including an inlet port between the seal means for receiving chemicals and a passageway leading from the inlet port to an outlet port, and a valve seat and valve element positioned in the passageway, the improvement of an operating mechanism comprising, a piston in the body above said inlet port connected to the valve element, said piston including an upwardly directed metal cup seal, a downwardly directed metal cup seal, and a gas pressure charge in said body above said piston acting on the piston in a direction to close said valve element on said valve seat.

2. The apparatus of claim 1 including, a resilient seal between the metal seals.

3. The apparatus of claim 1 including, oil in the body between the gas charge and said piston for acting as a barrier between the gas charge and said piston.

4. The apparatus of claim 1 including, a closed gas container positioned in the body above the piston containing the gas pressure charge, said container including a rupturable portion, and piercing means adjacent said rupturable portion for opening said container.

5. The apparatus of claim 4 wherein the piercing means is positioned between the container and said piston.

6. The apparatus of claim 4 including, biasing means between the container and said piercing means for initially preventing the container from being opened.

7. The apparatus of claim 4 wherein the container includes oil.

8. The apparatus of claim 4 wherein oil is provided in the body above the piston.

9. The apparatus of claim 4 wherein the container is positioned in a cylinder in the body which is sealess except for the piston.

10. In an injection valve for injecting chemicals into a well having a body with spaced seal means on the exterior of the body for sealing in a well conduit, said body including an inlet port between the seal means for receiving chemicals and a passageway leading from the inlet port to an outlet port, and a valve seat and valve element positioned in the passageway, the improvement of an operating mechanism comprising, a piston in the body above said inlet port connected to the valve element, said piston including an upwardly directed metal cup seal, and a downwardly directed metal cup seal, and a resilient seal between the metal seals, a gas pressure charge in said body above said piston acting on the piston in a direction to close said valve element on said valve seat, and lubricating and sealing means in the body between the gas charge and said piston for acting as a barrier between the gas charge and said piston.

11. In an injection valve for injecting chemicals into a well having a body with spaced seal means on the exterior of the body for sealing in a well conduit, said body including an inlet port between the seal means for receiving chemicals and a passageway leading from the inlet port to an outlet port, and a valve seat and valve element positioned in the passageway, the improvement of an operating mechanism comprising, pressure responsive means in the body above said inlet port connected to the valve element, and a closed gas container positioned in the body above the pressure responsive means containing the gas pressure charge, said container including a rupturable portion, and piercing means adjacent said rupturable portion for opening said container.

12. The apparatus of claim 11 wherein the piercing means is positioned between the container and the pressure responsive means.

* * * * *